United States Patent [19]

Fox

[11] Patent Number: 4,666,108

[45] Date of Patent: May 19, 1987

[54] EXTENSIBLE RAILROAD GRADE CROSSING GATE ARM

[75] Inventor: David K. Fox, Wayzata, Minn.

[73] Assignee: Railway Equipment Company, Minneapolis, Minn.

[21] Appl. No.: 830,534

[22] Filed: Feb. 18, 1986

[51] Int. Cl.[4] ..... B61L 29/04

[52] U.S. Cl. ..... 246/125; 362/368; 246/261; 246/272

[58] Field of Search ..... 246/125, 261, 272, 292, 246/293, 127, 479, 482, 483; 14/53, 60, 68, 50, 61, 54, 62; 403/104; 362/396, 368, 430; 116/63 R; 49/334, 141, 124, 93; 340/114 B; 24/459, 460, 555, 545, 561; 174/69

[56] References Cited

U.S. PATENT DOCUMENTS

| | | | |
|---|---|---|---|
| 494,390 | 3/1985 | Smith | 49/124 |
| 516,049 | 3/1894 | Harden | 246/482 |
| 545,701 | 9/1895 | Lattig | 246/483 |
| 913,974 | 3/1909 | Pettey | 246/126 |
| 1,211,676 | 1/1917 | Coleman | 246/483 |
| 2,386,161 | 10/1945 | Hawes | 403/104 |
| 2,598,196 | 5/1952 | Staley | 246/261 X |
| 2,792,559 | 5/1957 | Maberry | 339/32 R |
| 3,036,146 | 5/1962 | Kamen | 174/69 |
| 3,251,069 | 5/1966 | Clark | 24/545 X |
| 3,538,484 | 11/1970 | Passafiume | 174/69 X |
| 3,964,704 | 6/1976 | Karr | 246/125 |
| 3,994,457 | 11/1976 | Teasel | 246/125 |
| 4,053,760 | 10/1977 | Glazier | 362/396 X |
| 4,186,429 | 1/1980 | Johnston | 362/368 X |
| 4,460,811 | 7/1984 | Murr et al. | 200/51.03 |

FOREIGN PATENT DOCUMENTS

| | | | |
|---|---|---|---|
| 2451743 | 5/1976 | Fed. Rep. of Germany | 340/114 B |
| 0715690 | 12/1931 | France | 246/125 |

*Primary Examiner*—Robert B. Reeves
*Assistant Examiner*—Scott H. Werny
*Attorney, Agent, or Firm*—Merchant, Gould, Smith, Edell, Welter & Schmidt

[57] ABSTRACT

A railroad crossing gate (20) is disclosed having a novel crossing arm (24) which includes a first longitudinal arm (26) member with a telescopically inserted second longitudinal arm member (28). The second arm member (28) is slideable to any one of a plurality of extendable positions and a fastener plate (100) disposed between the first and second members (26, 28) is provided for urging the second member (28) against the first member (26) in friction locking engagement. A plurality of gate lamps (38) are provided having a housing (40) which includes a channel for receiving an upper edge of the crossing arm (24). Screws (50) on both sides of the housing (40) are turned until the housing (40) is secured to the crossing arm (24) in a friction fit. Extensible cables (70) with three-pronged connections connect the gate lamps (38) to circuitry to operate the gate lamps (38) in a predetermined pattern.

20 Claims, 8 Drawing Figures

FIG. 4
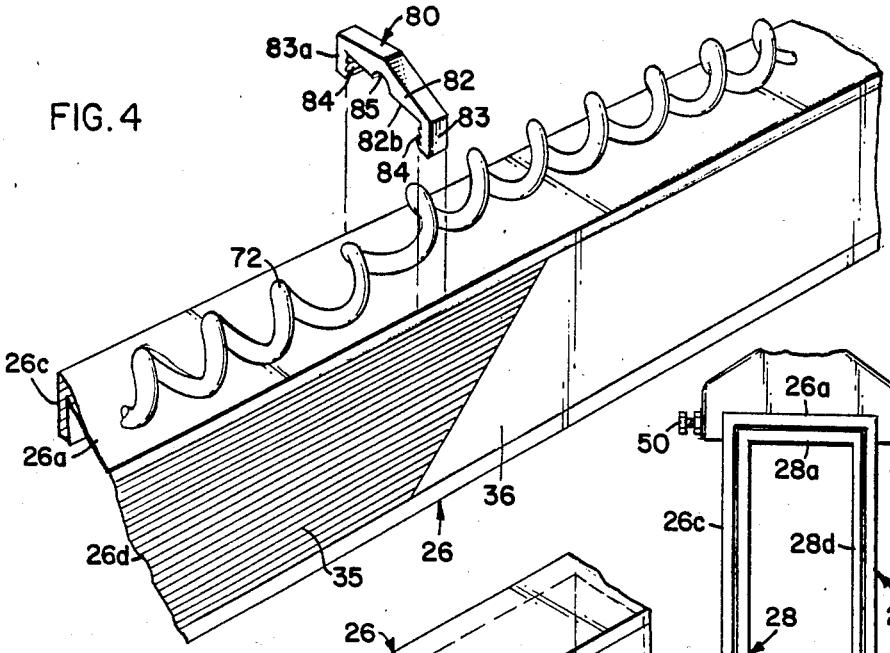
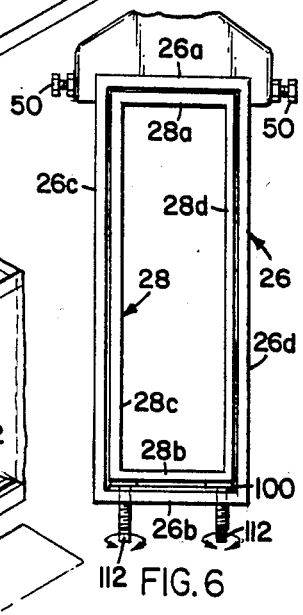
FIG. 6
FIG. 5
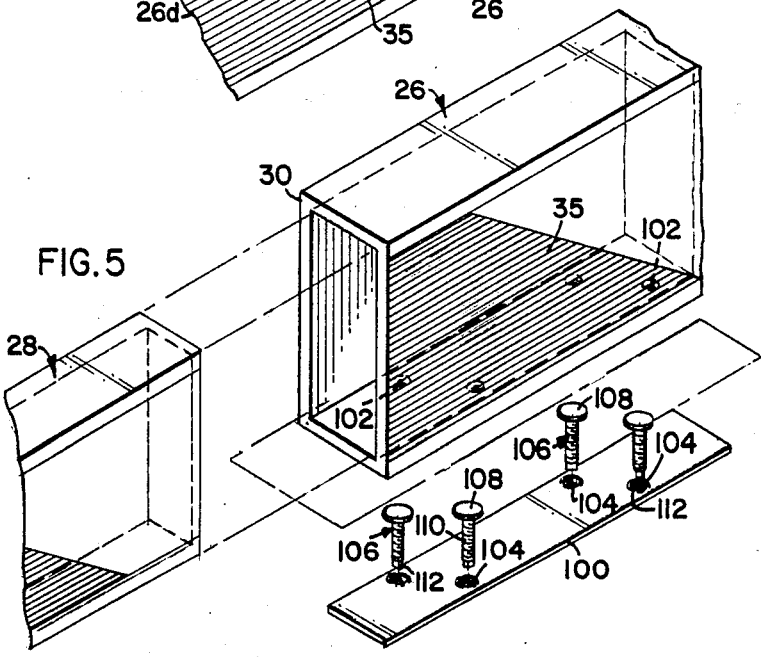
FIG. 8
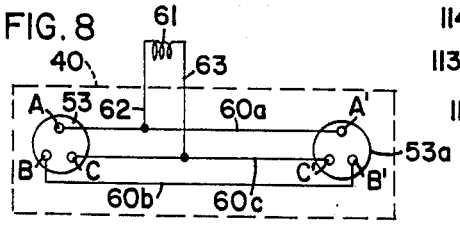
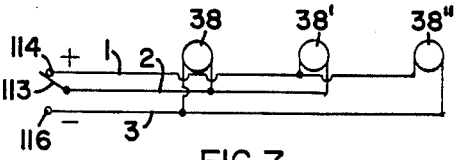
FIG. 7

EXTENSIBLE RAILROAD GRADE CROSSING GATE ARM

BACKGROUND OF THE INVENTION

I. Field of the Invention

This invention pertains to railroad grade crossing gate arms and, more particularly, to a railroad grade crossing gate arm having readily positionable and electrically interconnectable gate lamps on the gate crossing arm.

II. Description of the Prior Art

Railroad crossing gates are in wide spread use and are provided with long crossing arms for traffic barriers. The crossing arms are normally upright and are swung to a lowered, horizontal position when an approaching train is detected. The crossing arms of railroad crossing gates are provided with various signal lights which are secured to the crossing arm. Conventionally, three signal lights are used. A first light is disposed at the free end of the crossing arm. The remaining two lights are generally equispaced along the crossing arm. It is conventional that the lights be incorporated into an electrical circuit such that the light at the free end is constantly illuminated when the crossing arm is in its horizontal position. The remaining signal lights are disposed in the electrical circuit such that they are flashing with the two lights alternately flashing off and on.

The environments in which railroad crossing gates are employed are numerous. For example, the crossing gates may be placed adjacent to railroad lines in urban areas where they span streets of widely varying width. Likewise, rural installations also require spans of varying lengths. In addition to these customary settings, railroad crossing arms are found in many industrial settings which also require spans of various lengths.

Due to the indeterminant variety of crossing arm spans which may be required for a crossing gate installation, railroad crossing gates and their set up could not be standardized. For example, the length of the crossing arm could not be determined until the specific site at which the crossing gate was to be installed was known. Once the length of the gate arm was determined, the precise positioning of the signal lights (commonly referred to and hereafter referred to as gate lamps) could then be established. As noted above, the positioning of the gate lamps on the arm is such that the gate lamps are generally equispaced. Since the widths of the traffic lanes are not standardized from application to application, the positioning of the gate lamps on the arm must be done on a case by case basis. As is customary in prior art crossing gates, the gate lamp was secured to a junction box which was mounted on the gate arm either within an interior of the arm or on its exterior. In either event, mounting holes for the junction box would be drilled into the gate arm at each of the desired positions for a gate lamp. With the gate lamps installed, wiring would be run either inside or outside of the gate arm to connect the gate lamps in the appropriate circuitry for two of the lamps to be alternatingly flashing and the end lamp to be constantly illuminated when the arm was in the down position. This would require individual customized electrical work and customized cutting and splicing of wires as well as insuring that the appropriate wire from the circuit led to the appropriate gate lamp.

In light of all the individual manufacturing steps required to fabricate a finished crossing arm for a particular installation, the amount of time and effort required to install a crossing gate is substantial. This is particularly true where much of the installation steps take place in the field. While it would be desirable to standardize the assembly of a crossing arm, the art has not developed such a crossing gate.

OBJECTS AND SUMMARY OF THE PRESENT INVENTION

It is an object of the present invention to provide a grade crossing gate arm which is quick and easy to assemble for a variety of crossing arm spans even by an unskilled person.

A further object of the present invention is to provide a crossing arm having gate lamps which are quickly incorporated into an electrical circuit.

A yet further object of the present invention is to provide a gate lamp for a crossing arm which has a position dependent coupling for quickly connecting the gate lamp to a control circuit.

A further object of the present invention is to provide a railroad grade crossing gate arm with standard, interchangeable parts.

According to a preferred embodiment of the present invention, there is provided a crossing arm which includes a first longitudinal arm member. A plurality of electrically actuated gate lamps are provided with fasteners for independently fastening each of the gate lamps to any of a plurality of selected locations on the crossing arm. An elastic cable electrically connects each of the gate lamps to an electrical source. The gate lamps include electrical connectors which are position oriented such that when they are attached to the cable they will be in one of a plurality of operating modes dependent upon the position of connection.

BRIEF DESCRIPTION OF THE DRAWINGS

FIG. 4 is a view of the gate arm with an elastic cable showing a cable clamp in exploded view;

FIG. 5 is an exploded view taken in perspective of a portion of the gate arm showing apparatus for fixedly securing a telescoping portion of the arm in a desired position;

FIG. 6 is a side view of a telescoping member of the gate arm fixedly secured in position;

FIG. 7 is a diagrammatic view of the gate lamps electrically interconnected to the relay switch; and FIG. 8 is a diagrammatic view of the electrical interconnection within the gate lamp.

DESCRIPTION OF THE PREFERRED EMBODIMENT

Figure 1:
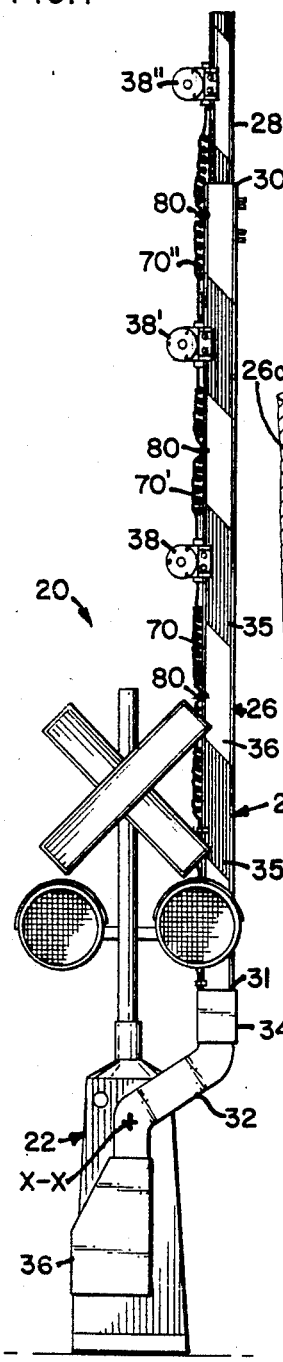
FIG. 1 is a view of a crossing gate having a gate arm according to the present invention.

Referring to FIG. 1, a railroad grade crossing gate is shown generally at 20. The gate 20 includes a gate stand 22 which is fixed in position along a road side adjacent a railroad line. A crossing arm of the present invention is generally shown at 24. In the embodiment shown, the crossing arm 24 includes a pair of longitudinal arm members including first arm member 26 and second arm member 28. It will be appreciated that in certain applications only one arm member or more than two arm members might be present depending on the crossing arm length required. For purposes of illustration; the preferred embodiment is described as having two arm members. Both of the arm members 26, 28 are hollow and rectangular in cross section with the arm members sized such that second arm member 28 is telescopically received within first arm member 26. A free end 30 of first arm member 26 is open such that second arm member 28 may slide freely to extend the length of arm 24 to any of a plurality of desired lengths. A second end 31 of first arm member 26 is connected to a pivot member 32 by means of any suitable conventional coupling 34. Pivot member 32 is secured to stand 22 for pivotable movement about a generally horizontal axis of rotation X—X. A weighted portion 36 of pivot member 32 on a side of axis X—X opposite that of arm 24 acts as a counter-weight.

Each of arm members 26 and 28 are provided with stationary indicators including alternating patches 35 and 36 of differing colors so that the arm 24 is conspicuous to an individual approaching the gate 20. The arm 24 is pivotable about axis X—X for rotation between a raised position (as shown in FIG. 1) and a lowered position (with the arm 24 extending horizontally away from stand 22) corresponding to open and closed positions, respectively, of the gate 20.

Figure 2:
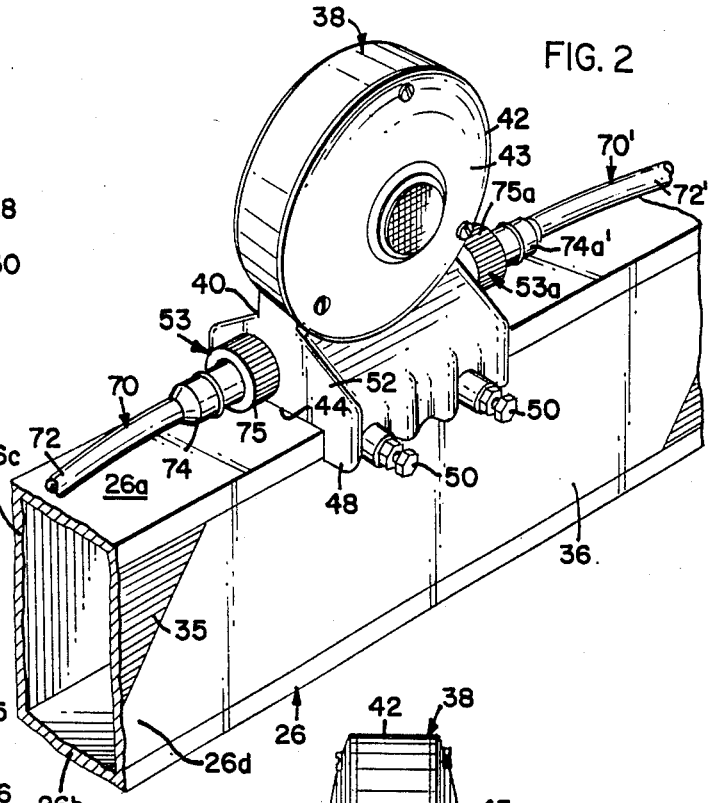
FIG. 2 is a perspective view of a portion of the gate arm showing a gate lamp secured to the arm.

In addition to the alternating patches 35 and 36, the gate arm 24 is provided with electrically actuated signals in the form of gate lamps 38, 38' and 38''. Each of the gate lamps is identical and a description of one will suffice as a description of the others. With reference to FIG. 2, gate lamp 38 is shown secured to first arm member 26. As can be seen in FIG. 2, arm member 26 is a hollow beam which is rectangular in cross section and includes a flat upper surface **26*a* disposed in parallel spaced relation to a lower plate 26*b* with surfaces 26*a* and 26*b* joined by spaced apart parallel side walls 26*c* and 26*d*. The gate lamp 38 includes a molded, one piece housing portion 40 and a light portion 42. The light portion 42 includes an electrical lamp housed between a pair of transparent diffuser plates such as plate 43 and 43*a*** which, conventionally, are colored red.

Figure 3:
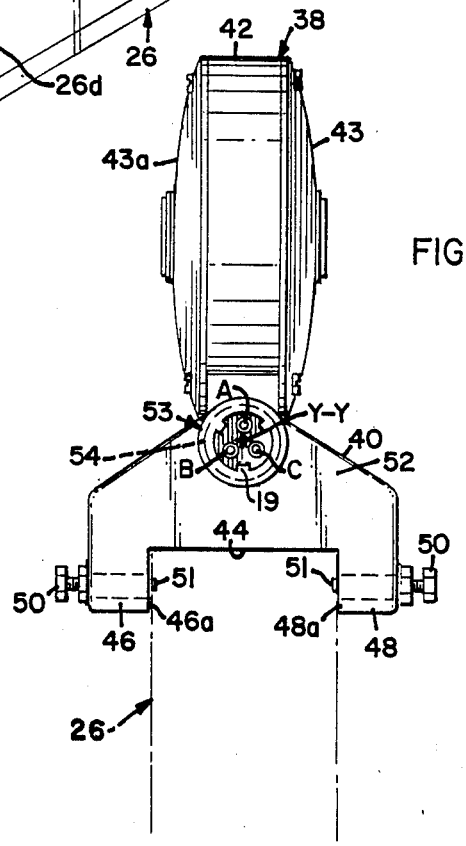
FIG. 3 is a side view of the gate lamp shown in FIG. 2.

With reference to FIGS. 2 and 3, the housing 40 has a flat bottom surface 44 having a width equal to the width of upper surface **26*a*. The housing 40 further includes a pair of downwardly extending side portions 46 and 48 which present parallel opposing surfaces 46*a* and 48*a* which are each generally perpendicular to surface 44. The surfaces 46*a*, 48*a* and 44 define a U-shaped channel sized to receive the upper surface 26*a* of arm member 26 slideably against surface 44. A pair of screws 50 are threadedly received through each of side portions 46 and 48 with free ends 51 of the screws 50 positioned to oppose walls 26*c* and 26*d* of arm member 26**.

Housing 40 has a pair of parallel end walls 52 which are generally perpendicular to bottom surface 44 and extend upwardly in a direction away from walls **46*a* and 48*a*. Disposed on each of walls 52 is a cable connector 53 and 53*a*, respectively. Connectors 53 and 53*a* are identical and a description of one will suffice as a description of the other. With reference to FIG. 3, connector 53 includes three electrical contact pins labeled A, B and C, respectively, which are housed within a protective shroud 54 integral with the housing 40 and having external threads. Each of pins A, B and C are arranged about an axis Y—Y equidistant from the axis Y—Y and spaced 120° apart. Preferably the protective shroud 54 includes inwardly projecting keys 19** spaced 120 degrees apart.

Housing 40 houses electrical wiring for operation of the lamp which is shown diagrammatically in FIG. 8. In the embodiment shown in FIG. 8, cable connector 53 is shown with its contact pin A, B and C as is cable connector **53*a* with contact pins labeled A', B' and C'. A first conductor 60*a* electrically connects pins A and A'. A second conductor 60*b* electrically connects pins B and B'. A third electrical conductor 60*c* electrically connects pins C and C'. In the embodiment shown, the lamp filament 61 has a first lead 62 fixedly and electrically connected to conductor 60*a*. A second lead 63 is fixedly and electrically connected to conductor 60*b*. Accordingly, lamp filament 61** will be illuminated when a potential is placed across pins A and B or A' and B'. It will be appreciated that varying wiring configurations might be utilized and still be in keeping with the principles of the present invention.

As shown in FIGS. 1, 2 and 4, the crossing arm 24 of the present invention includes extensible cable elements 70, 70' and 70'' each of which is identical and may be described with reference to cable elements 70 and 70'. The cable elements include an elastically coiled cable 72 extending between a pair of mating connectors 74 and **74*a*. Cable elements 70 include three conductors extending between pin receiving contacts carried in mating connectors 74, 74*a*. The mating connector 74 is urged into the shroud 54 of cable connector 53 with the pins A, B and C being received within aligned pin receiving connectors (not shown) carried by the mating connectors 74 to provide electrical connection between pin A and a first of the conductors carried by cable 70, pin B and a second of the wires carried by cable 70, and pin C and a third of the conductors carried by cable 70. Mating connector 74 is secured within cable connector 53 by means of a cap 75 having internal threads sized to threadedly engage the external threads of shroud 54. The connectors 74 and 74*a* include keyways for cooperating with the keys 19 of the shroud 54 so as to prevent insertion into the shroud 54** if not properly aligned.

It will be appreciated that due to the symmetric relationship of the pins A, B and C, the mating connector 74 can be received within the cable connector 53 in one of three angularly displaced positions. As a result, if the conductors of cable 70 can be referred to as conductors 1, 2 or 3, the connectors 74 and 53 can be connected in one of three positions including a first position with pin A connected to conductor 1, pin B connected to conductor 2 and pin C connected to conductor 3. A second position provides pin A being connected to conductor 2, pin B being connected to conductor 3 and pin C being connected to conductor 1. A third and final position provides pin A being connected to conductor 3, pin B being connected to conductor 1 and pin C being connected to conductor 2.

Referring to FIG. 4, a clamp mechanism 80 is shown for attaching cable element 70 to first arm member 26. The clamp includes a retaining portion 82 sized to extend the width of edge **26*a* and having a retaining surface 82*b* opposing surface 26*a*. A pair of side or securing portions 83 and 83*a* extend downwardly from retaining portion 82 with opposing surfaces of the securing portions 83 and 83*a* presenting jagged teeth 84 extending generally perpendicular to the longitudinal dimensions of portions 83 and 83*a*. Surface 82*b* is provided with a centrally located notch 85 having dimensions sufficient to accommodate the cable 70. Retaining clip 80 retains cable 70 on arm member 26 by forcing clip 80 downwardly onto surface 26***a* with cable 70 received within centrally located notch 85. Teeth 84 are urged onto surfaces 26*c* and 26*d* and provide a friction grip retaining the clip 80 in place. It will be appreciated that second arm member 28 and any additional members might include similar clamps suitably sized for the width of the respective arm member.

As previously described, arm member 28 is telescopically received within arm member 26 and is slideable therein for the composite crossing arm 24 to be extended to any one of a plurality of extended positions. In the embodiment shown, first arm member 26 is a hollow beam of aluminum. Second arm member 28 is a beam of fiberglass material. These materials provide low weight with adequate structural characteristics. It will be appreciated that various materials can be used in keeping with the invention. To hold arm members 26, 28 formed of these materials in a plurality of extended positions, a novel means for securing the second member in a desired extended position is provided.

With reference to FIG. 5 and 6, free end 30 of first member 26 is shown to receive second member 28 therein. As shown, first member 26 is a hollow beam of aluminum and having a rectangular opening sized to receive rectangular cross member 28. The distance between upper and lower surface 28*a* and 28*b* of second member 28 is sized to be slightly less than the distance between upper and lower surfaces 26*a* and 26*b* of first member 26. A stainless steel plate 100 is provided and sized to be received between the lower wall 28*b* of second member 28 and opposing lower wall 26*b* of member 26. Shown best in FIG. 5, the lower wall 26*b* of member 26 at free end 30 is provided with a plurality of threaded holes 102 extending through floor 26*b*. In the embodiment shown, four holes 102 are arranged in the pattern of a parallelagram. However, other patterns could be formed, as will be apparent. Also shown in FIG. 5, steel plate 100 is provided with a plurality of extruded threaded holes 104 formed completely through plate 100. Threaded holes 104 are disposed in a pattern such that steel plate 100 may be disposed upon bottom portion 26*b* with holes 104 aligned with holes 102, the extruded portion of the holes 104 of the steel plate 100 extending generally into the holes 102. A plurality of retaining screws 106 are provided each having a flat head 108 and a threaded shaft 110 extending from the head. In the embodiment shown, the end 112 of the shaft 110 opposite head 108 is a flat plate parallel to the axis of the shaft 110. It will be appreciated that the end 112 might take on varying configurations to enable operation thereon by a hand held tool or the like and still be in keeping with the principles of the present invention. To install the second member 28 within first member 26, steel plate 100 is inserted to abut lower wall 26*b* with holes 104 aligned with holes 102. Screws 106 are threaded through holes 104 and turned such that flat head 108 abuts plate 100 with free end 112 extending through the bottom wall 26*b*. Second member 28 is inserted into first member 26 with screw heads 108 disposed between plate 100 and bottom wall 28*b* in forced transmitting relation as shown in FIG. 6. By grasping free end 112 with any suitable tool (such as a pliers) an installer can turn screws 106 to thread the screw upwardly against wall 28*b* which thereby raises member 28 and urges upper wall 28*a* against upper wall 26*a* in friction fitting abutment.

After second member 28 has been inserted within first member 26 and placed in its desired extended position, second member 28 is secured in its desired position by means of the above-described installation procedure. With second arm 28 and properly extended and fixed in position, gate lamps 38 are installed in their respective positions, notably gate lamp 38″ is installed at the free end of arm member 24 and gate lamps 38 and 38′ are placed in their respective positions generally equidistant along arm 24. As can be seen from the structure of the gate lamp 38 as described above, the gate lamps 38, 38′ and 38″ can be quickly installed by simply placing the lamp housing 40 in its desired position with the upper edge 26*a*, 28*a* of the gates 26, 28 received within U-shaped channel defined by surfaces 44, 46*a* and 48*a*. Screws 50 are easily turned with any appropriate tool to urge the free end 51 of the screws in friction fit relation with side walls 26*c* and 26*d*.

With the lamps 38 so installed, the circuitry of the gate mechanism 20 can be completed. With reference to FIG. 7, the desired circuitry for the gate mechanism 20 is diagrammatically shown. Three conductors 1, 2 and 3 are electrically connected to conventional alternating relay switch 113, typically housed in or adjacent the gate stand 22, which alternates between contact with a positive pole 114 and a negative pole 116. A relay switch such as the switch 113 is conventionally used to provide an alternating signal at a railroad grade crossing gate arm. Therefore, the relay switch is only diagramatically illustrated in FIG. 7 as it may be housed at the railroad crossing arm site in numerous ways. In order to have lamp 38″ be continuously illuminated, it is desired to have lamp 38″ be in fixed electrical contact with conductors 1 and 3. It is desired to have lamp 38′ to be a flashing lamp. Accordingly, it is desired to have lamp 38′ electrically connected with conductor 1 and 2. It is also desired to have lamp 38 be a flashing lamp which flashes in phase opposite to that of lamp 38′. Accordingly, it is desired to have lamp 38 be electrically connected to conductors 2 and 3. It will be appreciated that the electrical connections for lamps 38 and 38′ could be reversed and the lamps would still flash alternately.

With the present invention, a person installing the gate arm 24 can rapidly make the necessary electrical connections to insure the desired performance of each of the lamps 38, 38′ and 38″. To this end, the electrical connection of switch 113 is made from the three conductors of cable 70 to the three conductors emanating from switch 113. This is preferably accomplished by using a three pin cable connector such as cable connectors 53. Regardless of the connection used, first mating connector 74*a* of cable 70 is electrically connected to the conductors of the switch 113. This connection can be made with any one of the three possible orientations between the switch conductors and the pin receiving contacts of the cable connector. The second mating connector 74 of the cable 70 is plugged into the first cable connector 53 of lamp 38. With a potential across poles 114, 116, the user looks at lamp 38 to be sure that it is flashing. If it is constantly illuminated, the mating connector 74 is removed and reoriented 120° in either direction and reinserted. So inserted into the cable connector 53, the lamp 38 will be flashing.

With lamp 38, properly connected to the circuit, mating connector 74*a′* of cable 70′ is inserted into second cable connector 53*a* of lamp 38 in any desired orientation to provide contact between the pins of the cable connector 53*a* and the pin receiving contacts of mating connector 74*a*'. The other end of the cable 70' is then inserted into a cable connector 53' of lamp 38' and the user checks to see that the lamp 38' is flashing alternately to the flashing of lamp 38. If not, the user reorients the positioning of the connection until the alternate flashing occurs. In a similar manner, lamp 38" is electrically connected to lamp 38' with the user orienting the electrical connection between cable 70" and lamp 38" until continuous illumination of the lamp is achieved.

From the foregoing, it can be seen that a crossing arm 24 of the present invention can be installed in an extremely rapid fashion. Arm member 26 is coupled to pivot arm 32 by coupling 34 and arm member 28 is slideably received in arm member 26 until it reaches its desired extended position at which point the fastening apparatus of plate 100 and screws 106 are adjusted to fixedly secure arm member 28 in its desired position. Each of the lamps 38, 38' and 38" are rapidly installed in their desired locations and the electrical connection is made between them. The proper electrical connection is made by simply forcing the cable mating connector into the cable connectors in trial and error fashion in one of three positions to make sure the lamps are properly operating in their desired sequence of operation. The gate lamps 38, 38', 38" are preferably interchangeable.

The retractable coil nature of each of the cables 72 takes up any spacing requirements between the various lamps 38 such that interchangeable and uniform cables 72 can be used. Moreover, in the preferred embodiment, the cables 72 are uniformly elastic along their length whereby excess cable length is uniformly compensated for over the length of the spans between adjacent gate lamps 38. Additionally, the coiled cables 72 have a size such that they can rest on top of the crossing arm. Clip members 80 hold each of the cables 70 in place.

Moreover, the installer need not worry about selecting a right or left crossing arm, since the present invention does away with the need for a left or right crossing arm, as the appearance of the crossing arm 24 is uniform from either direction.

While the foregoing is a preferred embodiment of the present invention, it will be appreciated there are numerous alternatives which will occur to those skilled in the art which could be used and still fall within the scope of the invention. For example, the three pin cable connectors could be replaced with four-pin connectors having pins A, B and C as well as a centrally located fourth pin D which would be common to all of the lamps. In this alternative embodiment, the fourth pin connector could be connected to a four wire cable having a first wire which will be common to all of the lamps, a second wire which would correspond to constant illumination, a third wire which would correspond to a first flashing illumination and a fourth wire that would correspond to a second flashing illumination which would alternate with the first. As a result of the various modifications of the present invention which could occur to those skilled in the art, it is intended that the scope of the present invention will be limited only to the scope of the claims as are, or may hereafter be, appended hereto.

What is claimed is:

1. A crossing arm arrangement for a gate mechanism having a signal relay switch circuitry, comprising:

an extensible crossing arm including a first longitudinal arm member;

a plurality of electrically actuated gate lamps;

fastening means for fastening a gate lamp to any of a plurality of selected locations along the length of said crossing arm; and extensible cable means for electrically connecting a gate lamp fastened to any of said plurality of selected locations to the relay switch circuitry of the gate mechanism, a cable connector being secured to said gate lamps and a mating connector secured to said cable means with said cable connector and mating connector joinable in a plurality of positions with said cable connector and mating connector providing a different electrical connection between said cable means and said gate lamp in each of said plurality of positions.

2. A crossing arm in accordance with claim 1 wherein said gate lamps are substantially identical and interchangeable.

3. A crossing arm in accordance with claim 1, wherein the cable means includes a coiled cable having substantially uniform elasticity, the cable means being substantially identical and interchangeable.

4. A crossing arm according to claim 1 comprising circuitry for said plurality of positions to include three positions with said gate lamps being constant with said connectors in a first position; said gate lamp being intermittent with said connectors in a second position and said gate lamp being intermittent with said connectors in a third position and out of phase with an intermittent gate lamp of said second position.

5. A crossing arm according to claim 1 wherein said fastening means includes a housing with said gate lamp secured to said housing, opposing surfaces of said housing defining a channel for receiving a longitudinal edge of said crossing arm at said plurality of selected locations, said fastening means including securing means for fixedly securing said housing on said crossing arm in a desired selected location.

6. A crossing arm according to claim 1 including a second longitudinal arm member slideably secured to a first end of said first arm member.

7. A crossing arm according to claim 6 wherein said second member is telescopically received within said first member; means for securing said second member in a desired extended position including a fastener having a first end disposed between opposing surfaces of said first and second members and an exposed end extending through said first member; means for holding said fastener in a plurality of fixed positions with said first end abutting said second member and urging said second member against said first member in locking engagement.

8. A crossing arm according to claim 7 wherein said fastener comprises a plate, sized to be received between opposing surfaces of said first and second member and having a plurality of extruded threaded holes formed therethrough and aligned with holes formed through said first member, a threaded screw having a head disposed between opposing surfaces of said second member and said plate and having a threaded portion threadedly engaging said extruded threaded hole and extending through said extruded threaded hole to an exposed free end.

9. A crossing arm according to claim 1 comprising clamp means for securing said cable means to an elongated edge of said crossing arm and including a retaining portion having a retaining surface opposing said edge with said cable means disposed between said edge and said surface; securing portions depending from said retaining portion and sized to engage opposing surfaces of said crossing arm in locking engagement with said cable means disposed between said edge and said surface.

10. A crossing arm according to claim 9 wherein said retaining surface is provided with a notch sized to receive said cable means.

11. An extensible crossing arm arrangement for a gate mechanism having signal relay switch circuitry arrangement, comprising:

an extensible crossing arm including a first longitudinal arm member and a second longitudinal arm member telescopically received within said first arm member;

securing means for securing said second longitudinal member in a desired extended position;

a plurality of gate lamps having an electrically illuminable lamp portion secured to a housing, said housing including cable connectors with electrical conductors extending between said cable connectors, said lamp portion being electrically interconnected to said electrical conductors for said lamp portion to be operated in one of a plurality of modes;

fastening means for fastening said gate lamps to any of a plurality of selected locations along the length of said crossing arm, said fastening means being adjustably interconnected to said gate lamp housing and engaging said crossing arm; and extensible, coiled cable means extending between said gate lamps for electrically interconnecting said cable connectors of said gate lamps.

12. A crossing arm according to claim 11, wherein said cable means is interconnected to said cable connectors in any of a plurality of positions, said gate lamp electrical conductors having an illuminating signal varying with said plurality of interconnection positions whereby said lamp portions are operated in one of said modes.

13. A crossing arm according to claim 11, wherein said gate lamps are substantially identical and interchangeable.

14. A crossing arm according to claim 11, wherein the cable means are substantially identical and interchangeable.

15. A crossing arm according to claim 11, wherein said cable means are interconnectable to said cable connectors of said gate lamps in any one of three positions.

16. A crossing arm according to claim 11, wherein said cable means include three mating connectors for receiving three pin connectors of said cable connectors which are disposed 120 degrees apart.

17. A crossing arm according to claim 11, wherein said fastening means includes threaded means threadedly received in said gate lamp housing and engaging said crossing arm.

18. A crossing arm according to claim 11, wherein said gate lamp housing is a molded, one piece plastic housing.

19. A crossing arm according to claim 14, wherein said gate lamp housing has a U-shaped base portion slideably receiving a top surface of said crossing arm with two parallel, spaced apart side wall portions extending adjacent sides of said gate crossing arm.

20. A crossing arm according to claim 11, wherein said securing means includes a plate member having a plurality of threaded, extruded holes being aligned with corresponding holes in a first surface of said first longitudinal arm member, said plate member being sized to be received between said first surface of said first longitudinal arm member and an opposing first surface of said second longitudinal arm member, threaded members being threadedly received in said plate member and said first longitudinal arm member, said threaded members having a substantially flat head portion disposed between said first and second longitudinal arm members and having an exposed free end portion.

* * * * *

UNITED STATES PATENT AND TRADEMARK OFFICE

CERTIFICATE OF CORRECTION

PATENT NO. : 4,666,108

DATED : May 19, 1987

INVENTOR(S) : David K. Fox

It is certified that error appears in the above-identified patent and that said Letters Patent is hereby corrected as shown below: Title page:

Under References Cited, Line 1, 494,390 3/1985 should be 494,390 3/1893.

Col. 6, Line 5, delete first occurrence of "and".

Col. 6, Lines 29-30, "diagramatically" should be --diagrammatically--.

Signed and Sealed this

Twenty-first Day of March, 1989

*Attest:*

*Attesting Officer*

DONALD J. QUIGG

*Commissioner of Patents and Trademarks*